US008348108B2

(12) United States Patent
Choi

(10) Patent No.: US 8,348,108 B2
(45) Date of Patent: Jan. 8, 2013

(54) DISPENSER FOR REFRIGERATOR

(75) Inventor: Dae-Jin Choi, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 374 days.

(21) Appl. No.: 12/681,871

(22) PCT Filed: Aug. 25, 2008

(86) PCT No.: PCT/KR2008/004953

§ 371 (c)(1),
(2), (4) Date: Apr. 6, 2010

(87) PCT Pub. No.: WO2009/048222

PCT Pub. Date: Apr. 16, 2009

(65) Prior Publication Data

US 2010/0236270 A1 Sep. 23, 2010

(30) Foreign Application Priority Data

Oct. 8, 2007 (KR) ..... 10-2007-0101094

(51) Int. Cl.

| | |
|---|---|
| ***B67D 3/00*** | (2006.01) |
| ***B67D 7/06*** | (2006.01) |
| ***B67D 7/80*** | (2006.01) |
| ***B65B 1/04*** | (2006.01) |
| ***B65B 3/00*** | (2006.01) |
| ***B65C 3/00*** | (2006.01) |
| ***F25D 3/00*** | (2006.01) |

(52) U.S. Cl. ..... 222/504; 222/146.6; 141/351; 62/389

(58) Field of Classification Search ..... 222/146.6, 222/504, 505; 141/351, 360–362, 369; 62/389
See application file for complete search history.

(56) References Cited

U.S. PATENT DOCUMENTS

| | | | | |
|---|---|---|---|---|
| 2,605,021 | A * | 7/1952 | Churchill et al. | 222/153.03 |
| 3,934,757 | A * | 1/1976 | Malek et al. | 141/362 |
| 4,089,436 | A * | 5/1978 | Marks | 222/504 |
| 4,090,641 | A * | 5/1978 | Lindenschmidt | 222/504 |
| 4,679,716 | A * | 7/1987 | Layton | 223/109 R |
| 4,741,355 | A * | 5/1988 | Credle et al. | 137/269 |
| 5,303,849 | A * | 4/1994 | Credle, Jr. | 222/129.1 |
| 5,442,933 | A | 8/1995 | Unger | |
| 6,135,173 | A * | 10/2000 | Lee et al. | 141/361 |
| 7,188,487 | B2 * | 3/2007 | Choi | 62/389 |
| 2004/0188466 | A1 * | 9/2004 | Choi | 222/146.6 |
| 2006/0065006 | A1 * | 3/2006 | Park | 62/344 |
| 2006/0131324 | A1 * | 6/2006 | Noh et al. | 221/150 R |

FOREIGN PATENT DOCUMENTS

| | | | |
|---|---|---|---|
| KR | 20-0130588 | Y1 | 1/1999 |
| KR | 1999-0031599 | | 7/1999 |
| KR | 10-2000-0000792 | A | 1/2000 |
| KR | 10-2004-0085403 | A | 10/2004 |

* cited by examiner

*Primary Examiner* — Kevin P Shaver
*Assistant Examiner* — Vishal Pancholi
(74) *Attorney, Agent, or Firm* — Birch, Stewart, Kolasch & Birch, LLP

(57) ABSTRACT

A dispenser for a refrigerator including a pushing member formed in a planar shape and configured to be movable in a back and forth direction, a switch configured to be operated by a pushing force applied to be parallel with the pushing member, and a motion conversion unit cooperating with the motion of the pushing member to enable the switch to be pushed, wherein the motion conversion unit includes an oblique member configured to be protruded obliquely from one side of a rear surface of the pushing member, and a transfer member coming in contact with the oblique member and the switch and having one side fixed to be rotatable in parallel with the pushing member.

7 Claims, 5 Drawing Sheets

DISPENSER FOR REFRIGERATOR

TECHNICAL FIELD

The present invention relates to a refrigerator, and more particularly, to a dispenser for a refrigerator for discharging out water or ice cubes from the dispenser of the refrigerator.

BACKGROUND ART

Generally, a refrigerator, an appliance for storing food at a low temperature, stores foods in a freezing manner or a cooling manner depending upon states of foods to be stored.

Currently, the refrigerators have been large and multifunctional according to various demands of users and changes of dietary life thereof. Such refrigerator generally has a dispenser for discharging out purified water or ice cubes without opening a door thereof.

The dispenser is generally formed at the door of the refrigerator and is manipulatable in various manners. An exemplary dispenser in the related art is shown in FIG. 1.

FIG. 1 is a side section view schematically showing a dispenser for refrigerator in the related art.

Referring to FIG. 1, the dispenser for refrigerator 10 includes a dispenser housing 11 and a deco cover 12.

The dispenser housing 11 forms a shape of an inner side of the dispenser 10. The dispenser housing 11 is concaved toward the inside of the refrigerator door by a specific depth so that a space for receiving a cup (C) or a container similar to the cup for receiving water or ice cubes therein may be formed.

The deco cover 12 is disposed at a front side of the dispenser housing 11 so as to form an external appearance of the dispenser 10 by partially shielding a front surface of the dispenser housing 11.

The deco cover 12 is provided with an opening corresponding to the space of the dispenser housing 11. Through the opening, the cup (C) for discharging out water and ice cubes is taken in and out.

The dispenser housing 11 has an upper middle portion provided with a discharge outlet 13 for downwardly supplying water or ice cubes.

And, a manipulation lever 14 is formed at a middle portion of an inner side surface of the dispenser housing 11.

The manipulation lever 14 has an upper end coupled to one side of the dispenser housing 11 or the dispenser 10 by a hinge. A switch 16 for determining an operation of the dispenser 10 is provided at one side of a rear surface of the dispenser housing 11. And, a transfer mechanism 15 is provided at the rear surface of the dispenser housing 11.

The transfer mechanism 15 is rotatably mounted at the rear surface of the dispenser housing 11. When one end portion 15*a* of the transfer mechanism 15 coming in contact with the manipulation lever 14 is pushed, the other portion 15*b* of the transfer mechanism 15 pushes the switch 16 by the rotation of the transfer mechanism 15.

However, in the aforementioned dispenser of the refrigerator in the related art, since the transfer mechanism is rotated with respect to the rear surface of the dispenser housing, a spare space for rotation of the transfer mechanism is required to be formed at the rear surface of the dispenser housing, thereby enlarging an installation space for the dispenser for refrigerator and decreasing a storage space of the refrigerator.

DISCLOSURE OF THE INVENTION

Technical Problem

Therefore, it is an object of the present invention to provide a dispenser for a refrigerator which is capable of decreasing an installation space for the dispenser of the refrigerator.

Technical Solution

To achieve the object, there is provided a dispenser for refrigerator comprising: a pushing member formed in a planar shape and configured to be movable in back and forth direction; a switch configured to be operated by a pushing force applied to be parallel with the pushing member; and a motion conversion unit cooperating with the motion of the pushing member so as for the switch to be pushed.

Here, the motion conversion unit comprises an oblique member configured to be protruded with being oblique from one side of a rear surface of the pushing member; and a transfer member coming in contact with the oblique member and the switch and having one side fixed to be rotatable in parallel with the pushing member.

Further, the transfer member is implemented as two bar members sharing one rotation shaft and coupled to each other in a state that they are spaced from each other by a specific angle. And, one end and the other end thereof respectively come in contact with the oblique member and the switch.

Further, the two bar members are disposed at a rear surface of a dispenser housing forming an external appearance of the dispenser and are spaced from each other by at least more than a protruded length of the oblique member.

The switch is disposed at the rear surface of the dispenser housing forming the external appearance of the dispenser.

Further, the pushing member has the other end configured to be rotatable centering one end thereof.

Here, the pushing member has both side ends of an upper portion provided with a rotating protrusion protruded sideward, wherein the rotating protrusion is rotatably provided at one side of the dispenser housing forming the external appearance of the dispenser.

The pushing member is elastically supported at one side of the dispenser housing forming the external appearance of the dispenser.

Here, the pushing member is supported at right and left ends of an upper end thereof and right and left ends of a lower end thereof.

Advantageous Effects

The dispenser for refrigerator according to the present invention has the following advantages.

First, since a motion conversion unit is provided so as to operate the switch resulting from that the transfer member is rotated in parallel with the rear surface of the dispenser housing, it is capable of decreasing an installation space for the dispenser.

Second, since it is capable of converting a direction of a force using simple configurations such as the transfer member, the oblique member, there may exist a small number of portions where undesired operations may occur, thereby enhancing reliability of operations of the dispenser.

MODES FOR CARRYING OUT THE PREFERRED EMBODIMENTS

Description will now be given in detail of a dispenser for refrigerator in accordance with a first embodiment of the present invention, examples of which are illustrated in the accompanying drawings.

Figure 1:
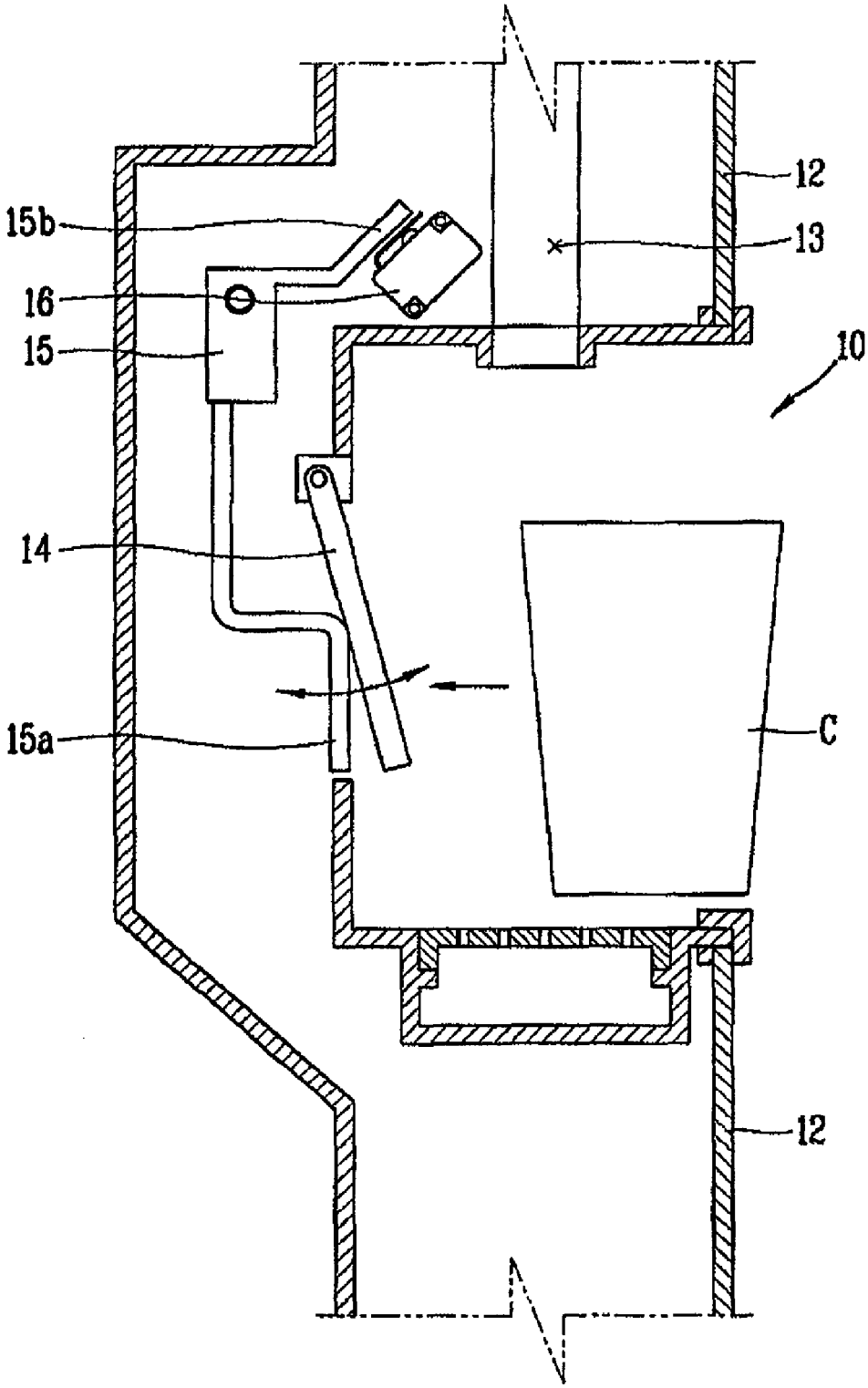
FIG. 1 is a side section view showing a dispenser for refrigerator in the related art.
Figure 2:
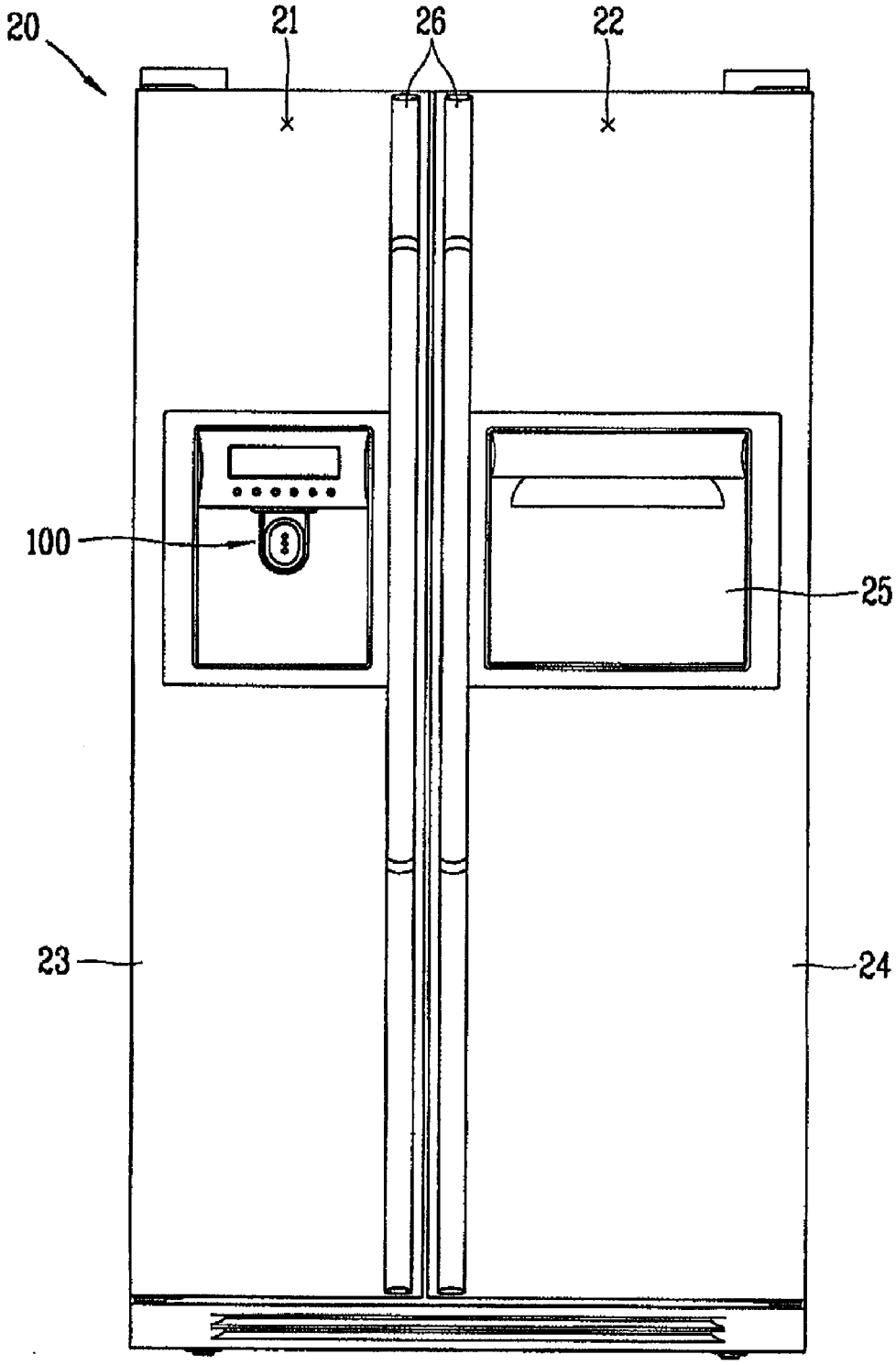
FIG. 2 is a front view showing an external appearance of a refrigerator to which a dispenser for refrigerator in accordance with a first embodiment of the present invention is applied.

FIG. 2 is a front view showing an external appearance of a refrigerator to which the dispenser for refrigerator in accordance with the first embodiment of the present invention is applied.

Referring to FIG. 2, a main body 20 forming the external appearance of the refrigerator is approximately formed in a rectangular parallelepiped shape. A cooling chamber 22 and a freezing chamber 21, storage spaces for storing foods therein respectively in a chilling manner and a freezing manner, are respectively formed in the main body 20. Each front surface of the freezing chamber 21 and the cooling chamber 22 is configured to be open.

And, refrigerator doors 23, 24 are respectively provided at the opened front surfaces of the freezing chamber 21 and the cooling chamber 22. The refrigerator doors 23, 24 serves to selectively shield the opened front surfaces of the freezing chamber 21 and the cooling chamber 22 and are composed of the freezing chamber door 23 and the cooling chamber door 24. The refrigerator doors 23, 24 are respectively coupled to both sides of a front end portion of the main body 20 by hinges so as to be rotatable thereat.

Meanwhile, door handles 26 are provided at the front surfaces of the freezing chamber door 23 and the cooling chamber door 24. The door handles 26 are grasped by a user so that the refrigerator doors 23, 24 can be easily rotated. The door handles 26 are approximately formed in a cylindrical bar shape to be long in upper and lower directions.

And, a home bar 25 is provided at the cooling chamber door 24. The home bar 25 serves to discharge in or out water or a beverage, which is contained in a container and is frequently taken in/out without opening the cooling chamber door 24. The home bar 25 is formed at the front surface of the cooling chamber door 24.

The freezing chamber door 23 is provided with a dispenser 100. The dispenser 100 serves to easily discharge out purified water or ice cubes without opening the freezing chamber door 23. The dispenser 100 is configured to be exposed toward the front surface of the freezing chamber door 23. Alternately, the dispenser 100 may be provided at the cooling chamber door 24.

Figure 3:
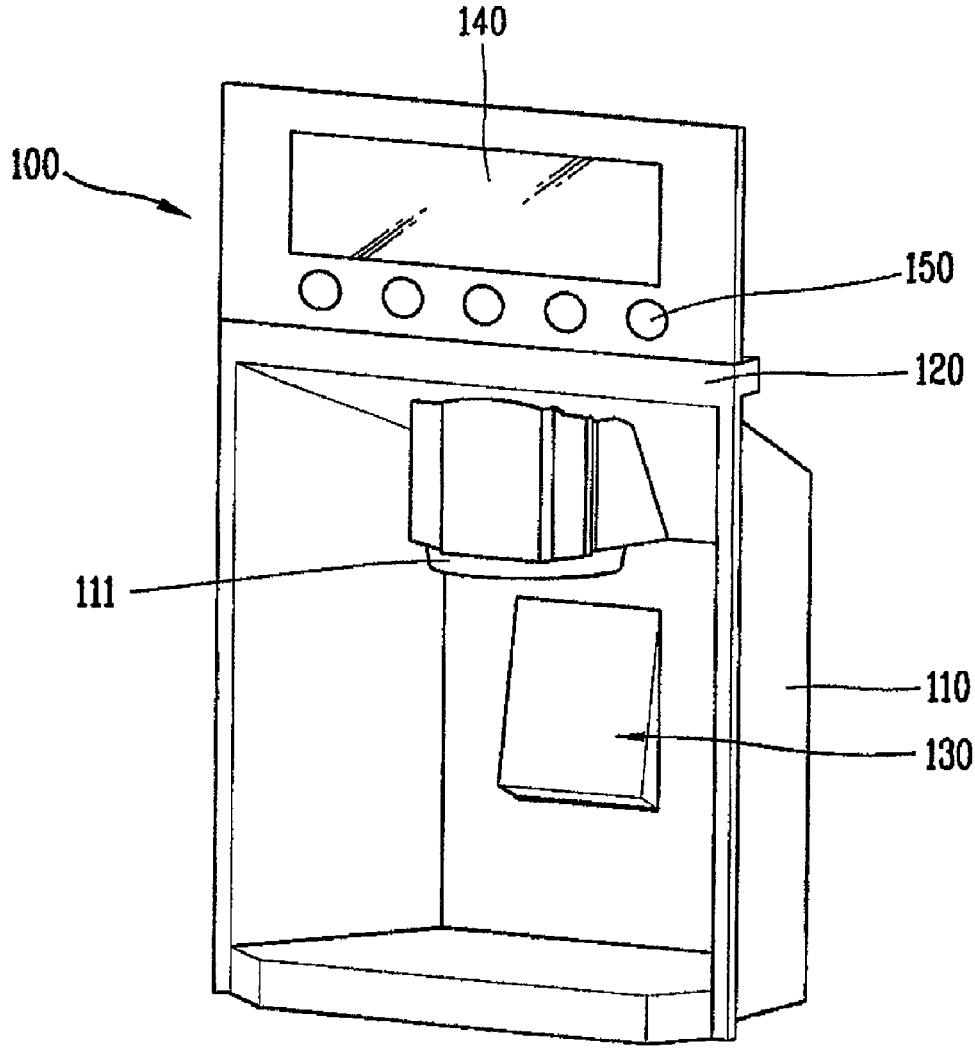
FIG. 3 is a cut perspective view showing a configuration of the dispenser for refrigerator in accordance with the first embodiment of the present invention.

FIG. 3 is a cut perspective view showing a configuration of the dispenser for refrigerator in accordance with the first embodiment of the present invention.

Referring to FIG. 3, the dispenser 100 of the refrigerator in accordance with the present invention includes a dispenser housing 100, a deco cover 120, a dispenser operating apparatus 130, a display 140 and manipulation buttons 150.

The dispenser housing 110 forming an inner shape of the dispenser 100 is concaved toward the inside of the freezing chamber door 23 (see FIG. 2) by a specific depth. Also, the dispenser housing 110 is configured to be rounded by a specific curvature so as to obtain an excellent external appearance and convenience on use.

The dispenser housing 110 have an upper middle portion provided with a discharge outlet 111 downwardly opened so as to discharge out water and ice cubes therethrough.

An opened lower end portion of the discharge outlet 111 is provided with the dispenser operating apparatus 130 for operating the dispenser 100. Preferably, the dispenser operating apparatus 130 is provided at an inside of the dispenser housing 110 so that the user can manipulate it with a container such as a cup (C, see FIG. 2) and receive water or ice cubes in the container.

The deco cover 120 serves to shield inner components of the dispenser 100 and form the external appearance of the dispenser 100 exposed toward the front surface of the freezing door 23 (see FIG. 2). The deco cover 120 is coupled to a front end portion of the dispenser housing 110.

The deco cover 120 is provided with an opened portion opened in a square shape so that a space concaved by the dispenser housing 110 can be exposed out.

A display 140 is provided at an upper portion of the deco cover 120 so as to display information about an operation of the dispenser 100 including overall operation information of the refrigerator. And, a plurality of manipulation buttons 150 are provided at a lower side of the display 140 so as to manipulate states of beverages and ice cubes discharged out through the dispenser 100.

Figure 4:
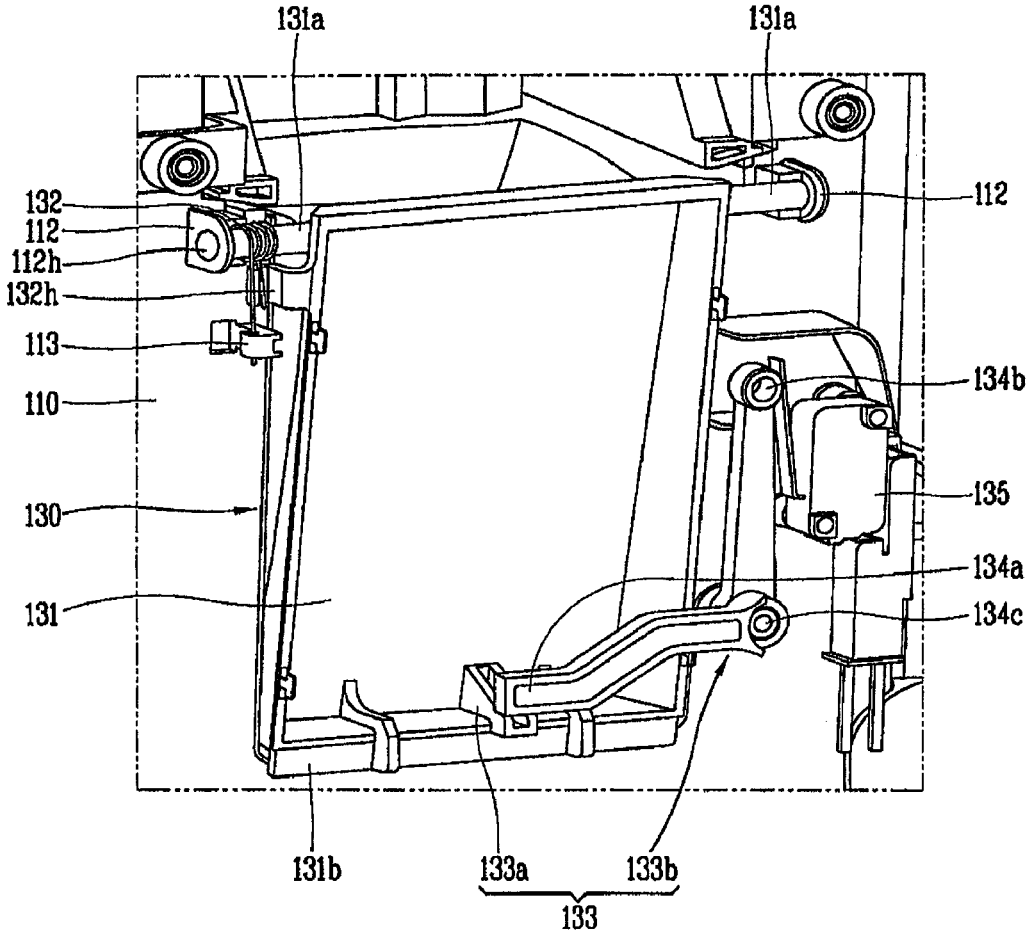
FIG. 4 is a view showing a rear side of a dispenser operating apparatus in the dispenser for refrigerator in accordance with the first embodiment of the present invention.

FIG. 4 shows a rear surface of the dispenser operating apparatus in the dispenser for refrigerator in accordance with the first embodiment of the present invention.

Referring to FIG. 4, the dispenser operating apparatus 130 of the refrigerator according to this embodiment includes a pushing member 131, a switch 135 and a motion conversion unit 133.

The pushing member 131 is generally implemented as a planar member in a rectangular shape. The pushing member 131 has an upper end portion configured to be rotatable with respect to one side of the dispenser housing 110 and thus moves in back and forth directions of the dispenser housing 110.

That is, a rotating protrusion 131 a is provided at both side ends of an upper portion of the pushing member 131 to be protruded sideward therefrom. And, the dispenser housing 110 is provided with a receiving protrusion 112 protruded toward a rear side of the dispenser housing 110 at a position corresponding to the rotating protrusion and provided with a receiving hole 112*h* for receiving the rotating protrusion 131*a*. The rotating protrusion 131*a* and the receiving protrusion 112 are coupled to each other by a hinge.

And, an elastic member 132, such as a torsion spring, is inserted into the rotating protrusion 131*a* so that the pushing member 131 can be restored after being pushed. The elastic member 132 is supported by locking protrusions 113, 132h formed at the rear surface of the pushing member 131 and the rear surface of the dispenser housing 110.

Further, a locking end 131*b* is formed at a lower end of the pushing member 131 so as to constantly maintain a position that the pushing member 131 is restored by the elastic member 132. Accordingly, the locking end 131*b* is locked by the dispenser housing 110 after the pushing member 131 is restored, thereby constantly maintaining a restoration position of the pushing member 131.

The switch 135 is disposed at one side of the rear surface of the dispenser housing 110 and is operated by a pushing force applied in a direction parallel with the pushing member 131.

The motion conversion unit 133 is configured to convert a motion of the pushing member 131 in back and forth directions into a motion rotating with being parallel with the pushing member 131 so as for the switch 135 to be pushed. Accordingly, the switch 135 is pushed with cooperating with the motion of the pushing member 131.

The motion conversion unit 133 includes an oblique member 133*a* and a transfer member 133*b*.

The oblique member 133*a* is protruded to be oblique from the rear surface of the pushing member 131 so that the transfer member 133*b* to be explained may be moved over the oblique member 133*a* in upper and lower directions along the motion of the pushing member 131. In FIG. 4, the oblique direction of the oblique member 133*a* is shown toward a circumference of the pushing member 131 for explanation, however, it is obvious that the direction can be varied by those skilled in the art.

The oblique member 133*a* can be installed at a certain position of the rear surface of the pushing member 131. However, it is preferable that the oblique member 133*a* is formed at a lower end of the rear surface of the pushing member 131 where a displacement is maximized resulting from that the pushing member 131 is pushed.

The transfer member 133*b* has one side provided with a first contact portion 134*a* and a second contact portion 134*b* respectively coming in contact with the oblique member 133*a* and the switch 135, and a fixed portion 134*c* fixed at the rear surface of the dispenser housing 110 so as to be rotated with being parallel with the pushing member 131.

The first contact portion 134*a* and the second contact portion 134*b* are configured to form a specific angle centering the fixed portion 134*c*. And, the second contact portion 134*b* is configured to have a rotation radius greater than that of the first contact portion 134*a* so that a large displacement can be transferred to the switch 135 even when a displacement of the first contact portion 134*a* is small, preferably.

And, in order to prevent interference between the motion of the pushing member 131 in back and forth directions and the rotation motion of the transfer member 133*b*, the transfer member 133*b* is disposed to be spaced from the rear surface of the dispenser housing 110 by a specific gap. That is, a distance between the transfer member 133*b* and the rear surface of the dispenser housing 110 is greater than a protruded length of the oblique member 133*a*, that is, a back displacement generated resulting from that the pushing member 131 is maximally pushed.

And, as another configuration for preventing interference between the motion of the pushing member 131 in back and forth directions and the rotation motion of the transfer member 133*b*, the transfer member 133*b* may be implemented as two bar members sharing one rotation shaft and each one end of the bar members comes in contact with the oblique member 133*a* and the switch 135. Here, the bar member coming in contact with the switch 135 is first fitted into the rotation shaft and then the other bar member coming in contact with the oblique member 133*a* is fitted into the rotation shaft. Accordingly, it is capable of preventing the bar member coming in contact with the oblique member 133*a* from being interfered with the motion of the pushing member 131 in back and forth directions.

Hereafter, referring to FIG. 4, an operation of the dispenser operating apparatus in the dispenser for refrigerator in accordance with the first embodiment of the present invention will be explained.

Referring to FIG. 4, when the user pushes the pushing member 131 coupled to one side of the dispenser housing 110 by a hinge, the pushing member 131 is rotated centering the hinge coupling shaft and then moved toward the rear surface of the dispenser housing 110.

Here, the first contact portion 134*a* coming in contact with the oblique member 133*a* provided at the rear surface of the pushing member 131 is moved upwardly in FIG. 4 along the oblique member 133*a* and then rotated centering the rotating protrusion 131*a* coupled to the dispenser housing 110. And, with cooperating with the movement of the first contact portion 134*a*, the second contact portion 134*b* is also rotated centering the fixed portion 134*c* and then transfers a pushing force to the switch 135.

Next, a dispenser for refrigerator in accordance with a second embodiment of the present invention will be explained. The refrigerator according to the second embodiment of the present invention has the same configurations as the first refrigerator, and thus its detailed explanation will be omitted.

Figure 5:
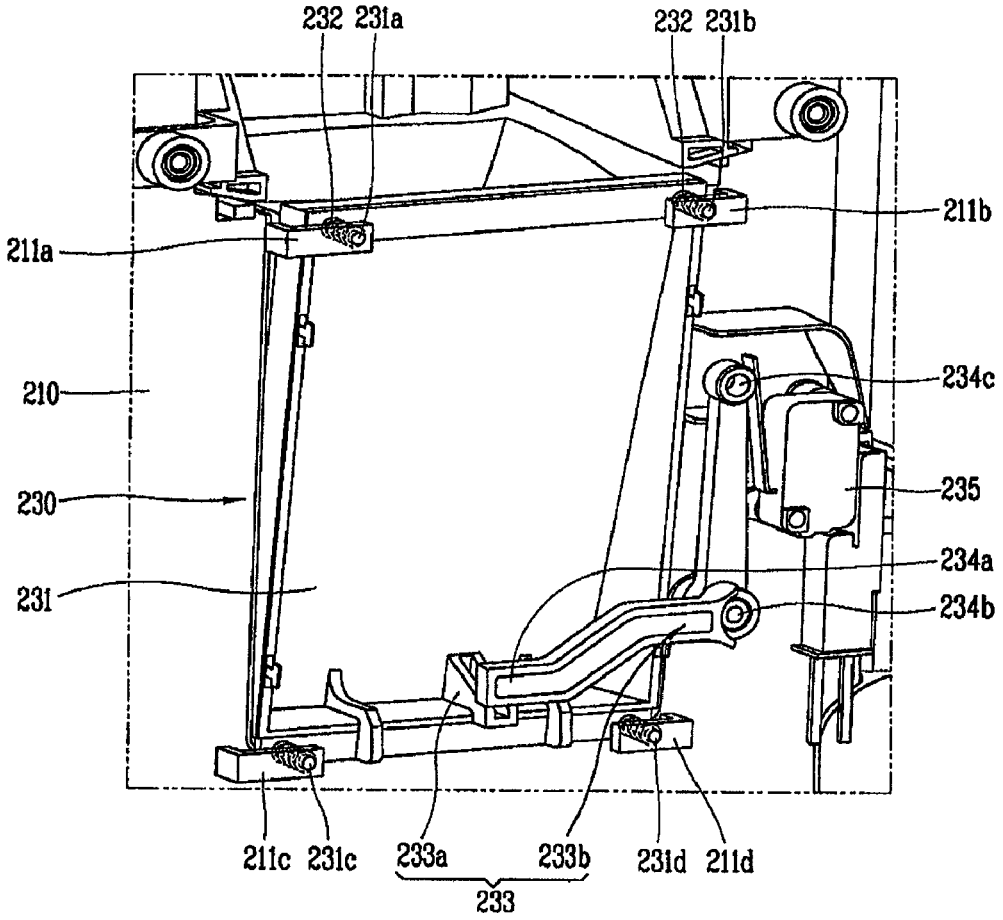
FIG. 5 is a view showing a rear side of a dispenser operating apparatus in a dispenser for refrigerator in accordance with a second embodiment of the present invention.

FIG. 5 shows a rear surface of a dispenser operating apparatus in the dispenser for refrigerator in accordance with the second embodiment of the present invention.

Referring to FIG. 5, in this embodiment, a pushing member 231 included in the dispenser operating apparatus 230 is generally implemented as a planar member in a rectangular shape and is elastically supported at one side of the dispenser housing 210 forming the external appearance of the dispenser. That is, fixed protrusions 211*a*, 211*b*, 211*c*, 211*d* formed at the dispenser housing and coupling protrusions 231*a*, 231*b*, 231*c*, 231*d* formed at the rear surface of the pushing member 231 are respectively coupled to each other, and elastic members 232 are respectively interposed between the fixed protrusions 211*a*, 211*b*, 211*c*, 211*d* and the coupling protrusions 231*a*, 231*b*, 231*c*, 231*d*.

Accordingly, the switch 235 can receive a pushing force even when a certain position of the pushing member 231 is pushed, thereby enhancing reliability of operations of the dispenser.

And, since the pushing member 231 is supported by four positions, the pushing member 231 can be more stably operated.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A dispenser for refrigerator comprising:

a pushing member formed in a planar shape and configured to be movable in back and forth direction;

a switch configured to be operated by a pushing force applied to be parallel with the pushing member; and a motion conversion unit cooperating with the motion of the pushing member so as for the switch to be pushed, wherein the motion conversion unit comprises:

an oblique member configured to be protruded with being oblique from one side of a rear surface of the pushing member; and a transfer member coming in contact with the oblique member and the switch and having one side fixed to be rotatable in parallel with the pushing member.

2. The dispenser for refrigerator as claimed in claim 1, wherein the transfer member is implemented as two bar members sharing one rotation shaft and coupled to each other in a state that they are spaced from each other by a specific angle, and one end and the other end thereof respectively come in contact with the oblique member and the switch.

3. The dispenser for refrigerator as claimed in claim 2, wherein the two bar members are disposed at a rear surface of a dispenser housing forming an external appearance of the dispenser and are spaced from each other by at least more than a protruded length of the oblique member.

4. The dispenser for refrigerator as claimed in claim 1, wherein the pushing member has the other end configured to be rotatable centering one end thereof.

5. The dispenser for refrigerator as claimed in claim 4, wherein the pushing member has both side ends of an upper portion provided with a rotating protrusion protruded sideward, wherein the rotating protrusion is rotatably provided at one side of the dispenser housing forming the external appearance of the dispenser.

6. The dispenser for refrigerator as claimed in claim 1, wherein the pushing member is elastically supported at one side of the dispenser housing forming the external appearance of the dispenser.

7. The dispenser for refrigerator as claimed in claim 6, wherein the pushing member is supported at right and left ends of an upper end thereof and right and left ends of a lower end thereof.

* * * * *